US007946278B2

(12) United States Patent
Lim

(10) Patent No.: US 7,946,278 B2
(45) Date of Patent: May 24, 2011

(54) CLOSED CRANKCASE VENTILATION SYSTEM

(75) Inventor: Jae Pil Lim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 1150 days.

(21) Appl. No.: 11/648,763

(22) Filed: Dec. 29, 2006

(65) Prior Publication Data

US 2010/0252008 A1 Oct. 7, 2010

(30) Foreign Application Priority Data

Nov. 20, 2006 (KR) ..... 10-2006-0114784

(51) Int. Cl.
*F02B 25/06* (2006.01)

(52) U.S. Cl. ..... 123/572

(58) Field of Classification Search ..... 123/572–574, 123/41.86, 195 A
See application file for complete search history.

(56) References Cited

U.S. PATENT DOCUMENTS

| | | | | |
|---|---|---|---|---|
| 4,493,295 A | | 1/1985 | Ampferer | |
| 4,958,613 A | * | 9/1990 | Hiraoka et al. | 123/572 |
| 6,101,994 A | * | 8/2000 | Ichikawa | 123/195 R |
| 2003/0116147 A1 | * | 6/2003 | Rengmyr | 123/572 |
| 2004/0244783 A1 | * | 12/2004 | Ookawa et al. | 123/572 |
| 2006/0144353 A1 | * | 7/2006 | Kim | 123/41.74 |

FOREIGN PATENT DOCUMENTS

| | | |
|---|---|---|
| JP | 59-23025 | 2/1984 |
| JP | 1986-88017 | 6/1986 |
| JP | 1992-65945 | 6/1992 |
| JP | 07-083019 | 3/1995 |
| JP | 2004-084606 | 3/2004 |
| JP | 2004-308539 | 11/2004 |
| JP | 2005-155423 | 6/2005 |
| KR | 1998-10674 | 5/1998 |
| KR | 2003-0072026 | 9/2003 |

* cited by examiner

*Primary Examiner* — M. McMahon
(74) *Attorney, Agent, or Firm* — Morgan, Lewis & Bockius LLP

(57) ABSTRACT

A closed crankcase ventilation system in which blow-by gas is introduced into an oil separator through a blow-by gas blowout opening provided in a truss structure of a cylinder block. A diaphragm is established in the truss structure of the cylinder block to close a portion of an oil hole portion returned from a cylinder head on the top thereof, thus preventing oil from flowing backward. An oil drain portion returns oil separated in the oil separator to an oil pan, and a gas recycling portion supplies blow-by gas separated in the oil separator to an intake manifold.

3 Claims, 2 Drawing Sheets

CLOSED CRANKCASE VENTILATION SYSTEM

CROSS-REFERENCE TO RELATED APPLICATION

This application claims the benefit of Korean Patent Application No. 10-2006-0114784 filed on Nov. 20, 2006, the entire disclosure of which is hereby incorporated by reference.

BACKGROUND OF THE INVENTION

1. Field of the Invention

The present invention relates to a closed crankcase ventilation system and, more particularly, to a closed crankcase ventilation system in which blow-by gas is introduced into an oil separator through a blow-by gas blowout opening.

2. Description of Related Art

In general, the blow-by gas is composed of partially-oxidized mixed gas, combustion gas and incompletely-combusted mixed gas. About a quarter of hydrocarbons exhausted from a vehicle is included in the blow-by gas. Since the blow-by gas is strongly acid, it causes corrosion in the engine and deterioration of oil.

Accordingly, the blow-by gas is forwarded from a combustion chamber into the crankcase of the engine and discharged from the crankcase to a head cover. Because of this account the oil becomes thin or deteriorated under the influence of heat or moisture of the combustion gas, gasoline, etc., thus generating sludge. To this end, an oil separator is typically provided to receive the blow-by gas generated in the process of the combustion in the engine and filter oil included in the blow-by gas to recycle the blow-by gas to an intake and drain the oil and impurities into an oil pan.

In a conventional oil separator, to oil separation portion typically separates oil included in the gas by rotating the introduced gas in an internal space thereof to reduce the flow rate and make the oil in the gas to adhere to the wall surface thereof using the centrifugal force. However, since the passenger and commercial diesel engines have a structure in which the blow-by gas is blown out from a rocker cover to be recycled, especially, overhead camshaft (OHC) engines have a relatively larger amount of oil and impurities due to the lubrication of cams, rocker shaft, etc.

Accordingly, at an early stage of designing the passenger and commercial diesel engines in which the oil consumption amount and the blow-by gas amount are relatively large, it is necessary to improve the durability of the turbo and intercooler system and to prevent the piston rings from being worn away due to carbons generated in the combustion chamber. Moreover, it is necessary to design the oil drain portion to be submerged in the oil at all times to prevent oil from flowing backward.

SUMMARY OF THE INVENTION

Embodiments of the present invention provide a closed crankcase ventilation system, in which blow-by gas is introduced into an oil separator through a blow-by gas blowout opening provided in a truss structure of a cylinder block, and a diaphragm is established in the truss structure of the cylinder block to close a portion of an oil hole portion returned from a cylinder head on the top thereof, thus preventing oil from flowing backward.

In an exemplary embodiment of the present invention, there is provided a closed crankcase ventilation system comprising a gas blowout opening established in a truss structure of a cylinder block; an oil separator receiving blow-by gas from the gas blowout opening to separate oil; an oil drain portion returning oil separated in the oil separator to an oil pan; and a gas recycling portion supplying blow-by gas separated in the oil separator to an intake manifold.

As a further exemplary embodiment, the truss structure of the cylinder block comprises a protrusion formed as a portion of the wall surface of the cylinder block protrudes and a plurality of vertical portions established parallel to each other in the vertical direction.

As another exemplary embodiment, the truss structure further comprises a horizontal portion intersected across the middle of the vertical portions.

Moreover, the gas blowout opening is provided on the right top of the vertical portion.

Furthermore, a diaphragm is formed in the middle of the horizontal portion in the vertical direction.

In addition, a head gasket closing a portion of an oil hole portion returned from a cylinder head is arranged in the right top of the vertical portion.

BRIEF DESCRIPTION OF THE DRAWINGS

The above and other features of the present invention will be described with reference to certain exemplary embodiments thereof illustrated the attached drawings in which.

DETAILED DESCRIPTION OF THE INVENTION

Figure 1:
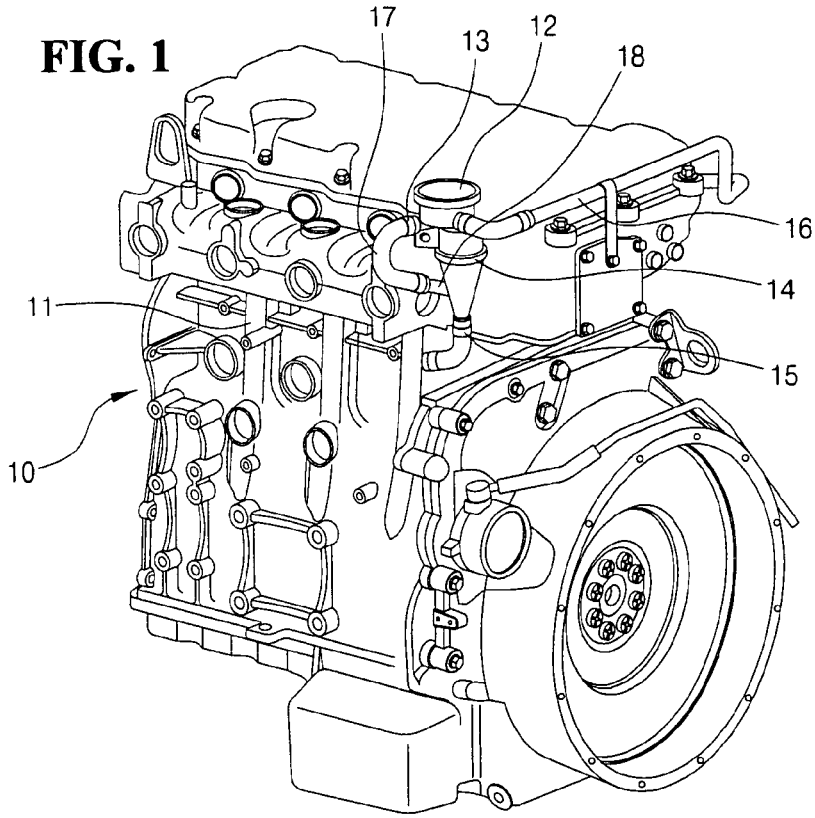
FIG. 1 is a perspective view depicting a closed crankcase ventilation system in accordance with a preferred embodiment of the present invention.
Figure 2:
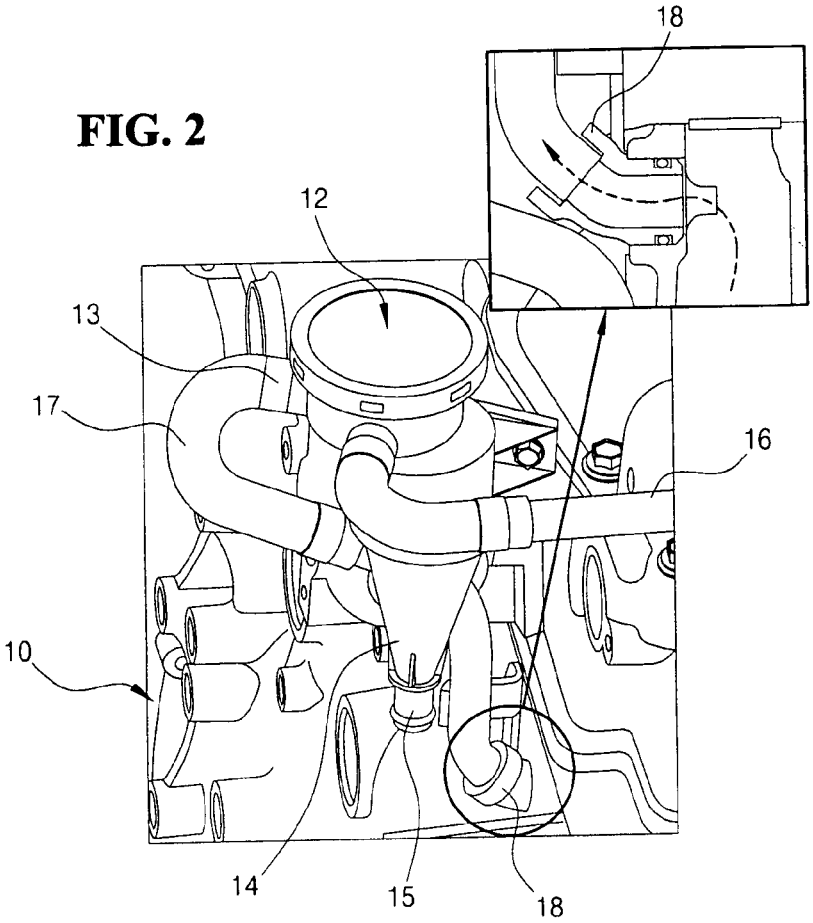
FIG. 2 is an enlarged perspective view depicting a structure of an oil separator in accordance with the present invention.
Figure 3:
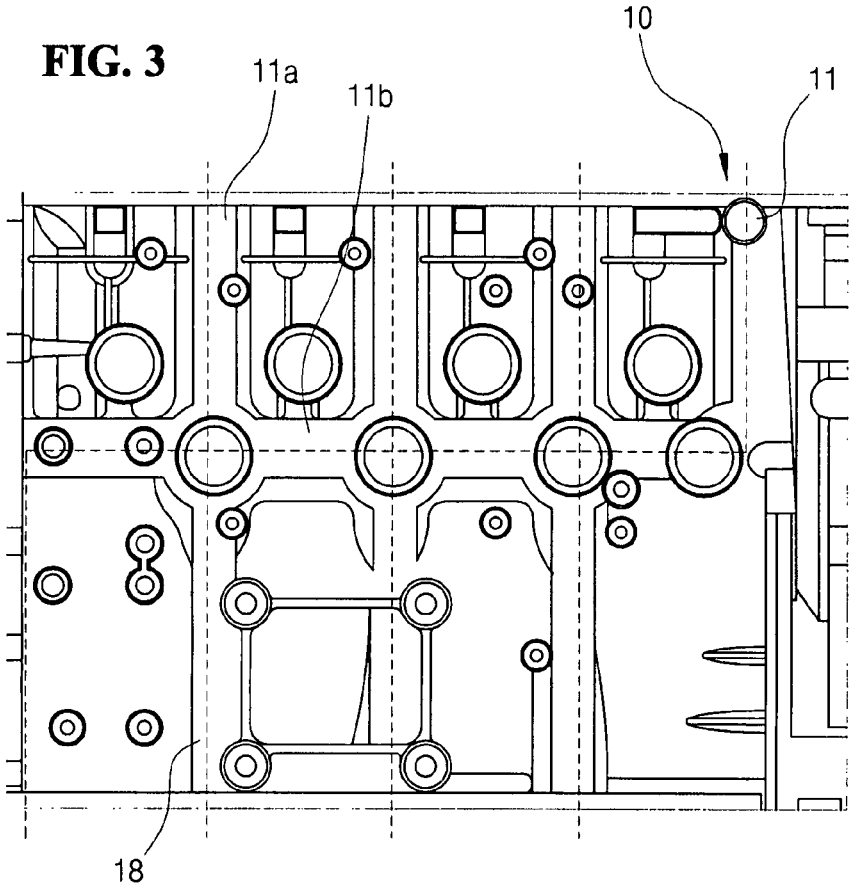
FIG. 3 is an external front view depicting a truss structure of a cylinder block for blowing out blow-by gas in accordance with the present invention.

Hereinafter, exemplary embodiments of the present invention will be described in detail with reference to the attached drawings.

With reference to FIGS. 1-4, embodiments of the present invention aim at improving the performance of a closed crankcase ventilation (hereinafter, referred to as the CCV) by blowing out blow-by gas from a cylinder block 10 and, at the same time, preventing oil from flowing backward by establishing a diaphragm in a truss structure 11 of the cylinder block 10.

An oil separator 12 separates oil included in the blow-by gas to drain the oil through an oil drain portion to be returned to an oil pan and to recycle the blow-by gas to an intake. The oil separator 12 comprises a gas inlet portion 13 through which the blow-by gas is introduced, an oil separation portion 14 in which the oil is separated by the gas velocity and the centrifugal force, an oil drain portion 15 draining oil and impurities filtered in the oil separation portion 14 to the oil pan, and a blow-by gas recycling portion 16 recycling the blow-by gas to an intake manifold.

A connecting hose 17 is established on the gas inlet portion 13 to connect the cylinder block 10, and a gas blowout opening 18 connected to one end of the connecting hose 17 to blow out the blow-by gas generated in the crankcase is provided on the cylinder block 10.

The gas blowout opening 18 is formed on one side of the top of the truss structure 11 of the cylinder block 10, and the truss structure 11 is primarily designed to reinforce the strength of the cylinder block 10; however, it is used as a path for blowing out the blow-by gas in the present invention. The truss structure 11 is provided in such a manner that a portion of the wall surface of the cylinder block 10 protrudes in the external direction, in which paths are arranged in the vertical and horizontal directions at regular intervals. In an exemplary embodiment, the truss structure 11 comprises a plurality of vertical portions 11*a* established in the vertical direction parallel to each other and a horizontal portion 11*b* formed in the horizontal direction interested across the middle of the vertical portion 11*a*.

The gas blowout opening 18 is arranged on the top of the most right end of the vertical portion 11*a*, a diaphragm 19 is established in the middle of the horizontal portion 11*b* in the vertical direction to prevent oil from flowing backward, and a head gasket 20 is established on the top of two right ends of the vertical portions 11*a* to close a portion of an oil hole portion returned from a cylinder head. The lower portion of the most right end of the vertical portion 11*a* is removed to prevent oil from being scattered through the gas blowout path.

The operation state of the closed crankcase ventilation system having the above configuration in accordance with the present invention will be described as follows.

First, according to the gas blowout path in accordance with the present invention, the gas is blown out through the cylinder block 10, differently from the conventional art in which the gas is blown out from the rocker cover and, especially, the gas blowout opening 18 is established on the truss structure 11 used for reinforcing the cylinder block to blow out the blow-by gas generated in the crankcase therethrough.

Figure 4:
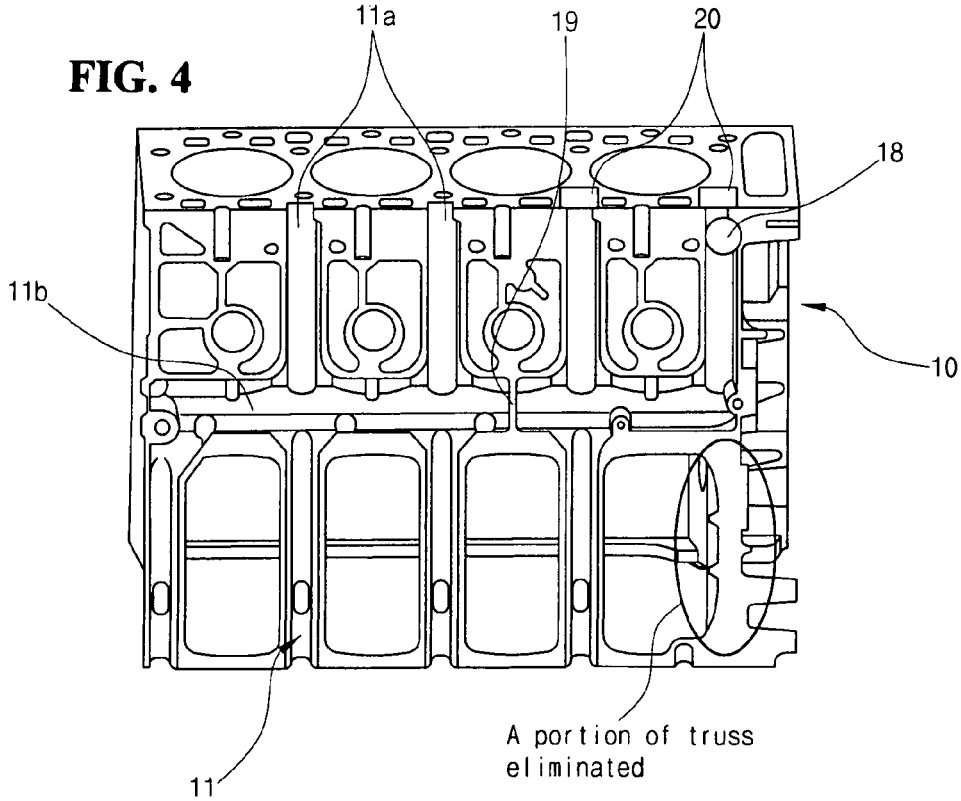
FIG. 4 is an internal diagram depicting a truss structure of a cylinder block for blowing out blow-by gas in accordance with the present invention.

As depicted in FIG. 4, the blow-by gas moving through the vertical portion 11*a* and a portion of the horizontal portion 11*b* in the truss structure 11 is escaped from the cylinder block 10 through the gas blowout opening 18 established on the top of the vertical portion 11*a* and introduced along the connecting hose 17 into the inside of the oil separator 12 through the gas inlet portion 13.

The blow-by gas introduced into the inside of the oil separator 12 is separated into gas and oil in the oil separation portion 14, in which the separated oil is returned to the oil pan through the oil drain portion 15 and the separated blow-by gas is introduced into the intake manifold through the blow-by gas recycling portion 16.

With the above-described configuration and operation in accordance with the present invention, the blow-by gas is introduced into the oil separator 12 through the gas blowout opening 18 established in the truss structure 11 of the cylinder block 10, thus reducing the flow amount of the blow-by gas and the oil separation amount to improve the CCV performance.

Moreover, it is possible to prevent oil from flowing backward and close a portion of the oil hole portion returned from the cylinder head on the top by the diaphragm 19 and the head gaskets 20 provided in the truss structure 11. Furthermore, it is possible to prevent oil from being scattered through the gas blowout opening 18 by eliminating a portion of the truss structure 11.

Test results in accordance with the positions of the gas blowout opening 18 in the conventional rocker cover and the cylinder block of the present invention are depicted in the following Table 1:

TABLE 1

| Intake | CCV Position | Blow-by | Blowout Amount [g/h] | Oil Separation Amount [g/h] | Intake Pressure [mmH2O] | C/case Pressure [mmH2O] | Remark |
|---|---|---|---|---|---|---|---|
| Normal | Locker | Normal | 3.6 | 121 | −350 | −110 | Reference of |
| Dirty | Cover | | 16.5 | 410 | −760 | −90 | blowout |
| Normal | | | 4.4 | — | −350 | −74 | amount: |
| Dirty | | | 4.9 | — | −760 | −100 | 3 g/h or less |
| Normal | Cylinder | | 1.1 | 4.3 | −350 | −103 | Reference of |
| Dirty | Block | | 1.1 | 4.1 | −760 | −93 | C/case: |
| Normal | Blowout | 50%↑ | 1.1 | 4.7 | −350 | −80 | −2000 mm |
| Dirty | | | 1.3 | 3.9 | −760 | −30 | H2O |

As depicted in Table 1, it can be seen that the blowout amount of the blow-by gas and the oil separation amount are reduced remarkably in the case where the blow-by gas is blown out from the cylinder block 10 in accordance with the present invention more than the case where it is blown out from the rocker cover.

That is, the blowout amount of the blow-by gas is increased four times and the oil separation amount is improved 30 to 100 times. Besides, the intake pressure and the crankcase pressure are equal to each other.

Accordingly, as a result of the above test, it can be found that the CCV performance of the present invention is improved considerably than the rocker cover blowout in accordance with the conventional art and the manufacturing cost is reduced as the baffle structure of the conventional rocker cover is removed. Moreover, the CCV system can be improved using the truss structure 11 configured originally for the purpose of reinforcing the strength of the cylinder block 10, thus improving durability of the turbo and intercooler system.

As described above, the closed crankcase ventilation system in accordance with the present invention improves the CCV performance by blowing out the blow-by gas from the truss structure of the cylinder block, differently from the conventional art in which the gas is blown out from the rocker cover, reduces the manufacturing cost by eliminating the baffle structure of the conventional rocker cover, and uses the truss structure configured for the purpose of reinforcing the strength of the cylinder block to improve the CCV performance and as well as the durability of the turbo and intercooler system.

As above, preferred embodiments of the present invention have been described and illustrated, however, the present invention is not limited thereto, rather, it should be understood that various modifications and variations of the present invention can be made thereto by those skilled in the art without departing from the spirit and the technical scope of the present invention as defined by the appended claims.

What is claimed is:

1. A closed crankcase ventilation system, comprising;

a gas blowout opening defined in a truss structure of a cylinder block;

an oil separator receiving blow-by gas from the gas blowout opening to separate oil;

an oil drain portion returning oil separated in the oil separator to an oil pan; and a gas recycling portion supplying blow-by gas separated in the oil separator to an intake manifold;

wherein the truss structure of the cylinder block protrudes as a portion of a wall surface of the cylinder block, the truss structure having:

a plurality of vertical portions established parallel to each other in a vertical direction with respect to a traverse direction of the cylinder block; and a horizontal portion intersected across the middle of the plurality of vertical portions;

wherein a diaphragm is formed in the middle of the horizontal portion in the vertical direction.

2. The closed crankcase ventilation system as recited in claim 1, wherein the gas blowout opening is provided on the right top of the vertical portion.

3. The closed crankcase ventilation system as recited in claim 1, wherein a head gasket closing a portion of an oil hole portion returned from a cylinder head is arranged in the right top of the vertical portion.

* * * * *